US006084521A

United States Patent [19]

Ha

[11] Patent Number: 6,084,521

[45] Date of Patent: Jul. 4, 2000

[54] WATERFLOW DETECTOR WITH ELECTRONIC TIMER

[75] Inventor: Simon Ha, Aurora, Ill.

[73] Assignee: Pittway Corporation, Chicago, Ill.

[21] Appl. No.: 09/059,475

[22] Filed: Apr. 13, 1998

[51] Int. Cl.[7] ..... G08B 21/00

[52] U.S. Cl. ..... 340/606; 340/609; 340/618; 340/644; 200/182; 200/186; 200/187; 200/190

[58] Field of Search ..... 340/606, 609, 340/615, 618, 506, 644; 73/861.78, 861.77; 277/634, 638; 137/115.06, 115.07, 551, 557, 558, 25, 26, 27, 28; 200/181, 190, 187, 182, 186

[56] References Cited

U.S. PATENT DOCUMENTS

| | | | |
|---|---|---|---|
| 3,921,989 | 11/1975 | Ward | 277/634 |
| 4,958,144 | 9/1990 | Griess | 340/606 |
| 5,240,022 | 8/1993 | Franklin | 137/1 |
| 5,315,294 | 5/1994 | Toth | 340/679 |
| 5,446,449 | 8/1995 | Lhomer et al. | 340/611 |
| 5,659,300 | 8/1997 | Dresselhuys et al. | 340/870.02 |
| 5,669,405 | 9/1997 | Engelmann | 137/115.07 |
| 5,680,329 | 10/1997 | Lloyd et al. | 364/551.01 |
| 5,705,987 | 1/1998 | Doner | 340/606 |

OTHER PUBLICATIONS

Potter Electric Signal Company, Vane Type Waterflow Switch With Electronic Retard; date unknown; MKT. #8800006–REV C; pp. 1 and 2.

Potter Electric Signal Company, Vane Type Waterflow Switch With Electronic Retard; May, 1995; MKT. #8800006–REV H; pp. 1 and 2.

*Primary Examiner*—Edward Lefkowitz
*Assistant Examiner*—Davetta W. Goins
*Attorney, Agent, or Firm*—Rockey, Milnamow & Katz, Ltd.

[57] ABSTRACT

A flow detector includes solid state delay circuitry coupled to a flow indicating device. In response to flow being indicated, the delay circuitry is enabled. After a preset delay interval, if flow is still being indicated, electrical energy can be provided by a short circuit to an output device for the duration of indicated flow. The flow indicating device can be a two-state mechanical switch. A short circuit supplying switch can be implemented as a solid state or mechanical latching relay. The flow detector circuits can be used independently to provide local alarms. Alternately they can provide alarm indicating signals to a common alarm control panel.

26 Claims, 3 Drawing Sheets

WATERFLOW DETECTOR WITH ELECTRONIC TIMER

FIELD OF THE INVENTION

The invention pertains to electronic timers used to help suppress transient signals. More particularly, the invention pertains to such timers used in waterflow detectors.

BACKGROUND OF THE INVENTION

Fire alarm systems have used a variety of technologies to attempt to provide audible or visible warnings of the existence of a fire condition to individuals in an area being monitored. In one known type of system, ambient condition detectors such as smoke, flame or thermal detectors are distributed in an area to be monitored. These units are often coupled via a communication link to a common control console or control panel.

The panel, in some instances, is capable of analyzing signals received from detectors to ascertain the presence of a fire condition. In other systems, a fire determination is made at the respective detectors and a signal indicative thereof is fed back to the control panel.

The above-described alarm systems are often used in combination with sprinkler systems. Known sprinkler systems incorporate sprinkler heads which are coupled to sources of fire suppressing liquids, such as water, or non-aqueous chemical suppressants.

The sprinkler heads are usually sealed with metals having relatively low temperature melting points. In response to the presence of heat from a fire, these metals soften and melt and release a fire suppressant.

Waterflow detectors have been used in such distribution systems to provide an indication that one or more of the sprinkler heads is delivering water to a portion of the region being monitored. Such waterflow detectors are disclosed, for example, in U.S. Pat. No. 4,782,333 entitled Waterflow Detector having Rapid Switching and U.S. Pat. No. 4,791,414 entitled Waterflow Detector. Both of the noted patents are assigned to the assignee hereof and are incorporated by reference herein.

Outputs from the waterflow detectors can in turn be used to directly energize alarm indicating visual or audible loads. Alternately, such signals can be coupled to an alarm system control panel for the purpose of providing additional warnings.

It is known that, from time to time, transient movement of water in a distribution system can occur in response to non-fire conditions. Such transient movement can be caused, by example, by intra-system water surges due to various causes.

Known water flow sensors often incorporate mechanical timers to incorporate a delay in an attempt to suppress such transience thereby minimizing false alarming. Known timers suffer from variability of the delays that are provided due to the mechanical timing mechanisms.

It would be desirable to provide highly repeatable transient suppressing delay intervals for use with waterflow sensors. Preferably such repeatable delay intervals could be achieved without introducing additional manufacturing complexity or manufacturing costs. It would also be desirable to be able to minimize power dissipation during no flow conditions.

SUMMARY OF THE INVENTION

A fluid flow detection unit incorporates a flow sensor which is coupled to a flow indicating switch having an open circuit state and a closed circuit state. A delay switch having an open circuit state and a closed circuit state is also provided. The flow indicating switch and the delay switch are both coupled to an electronic timer.

When the flow indicating switch exhibits a state indicative of the presence of flow, the electronic timer is enabled. When the timer generates an output, after a pre-set delay and if the flow indicating switch is still indicating fluid flow, then non-transient fluid flow is probably present. The delayed output from the timer can be used to close the delay switch. In response to the two switches having changed state, energy can be provided to a load.

In one aspect of the invention, energy can be provided to an audible or a visual alarm indicating device. Alternately, or in addition, an alarm indicating signal can be provided to a control panel for an alarm system monitoring the region of interest.

In another aspect, the flow indicating switch can be coupled in series with the delay switch. In response to the flow indicating switch assuming a closed state, indicative of the presence of flow, a timer can be enabled.

Once the timer circuit times out, after its preset delay interval, and assuming that the flow indicating switch is still exhibiting a closed circuit state, the delay switch can be closed enabling a transfer of electrical energy from an input terminal, associated with the flow indicating switch, to an output terminal, associated with the delay switch. The electrical energy can in turn be transferred to a local alarm indicating unit and/or an associated alarm system.

In yet another aspect, each time the flow indicating switch goes from a closed, flow indicating state, to an open, no flow state, the timer circuitry can be reset. Further, the delay switch can be implemented as a latching switch which will continue to exhibit a low impedance state for as long as the flow switch indicates the presence of flow in the associated conduit. Finally, when in the no flow state, the timer circuit can be forced into a minimal power quiescent state.

When used with an alarm system, the flow indicating circuitry can be coupled to a power supply operable under the control of the alarm system control panel. The control panel can in turn switch the power supply from an inactive to active state.

Switching the power supply to an active state in turn energizes the switches associated with each of the flow sensors and simultaneously resets each of the latch-type, delay, switch to an open circuit state. Hence, subsequent to the fire condition having brought under control, the panel can de-energize and re-energize the waterflow detection circuitry thereby resetting each of the respective latching switches thereby open-circuiting each such circuit.

The flow indicating switches can be implemented as mechanical switches or as solid state switches without limitation. The latching, delay switches can be implemented as mechanical latching switches such as reed relays or latching relays without limitation. The timer circuitry can be implemented with solid state counters which can be preset to provide an output after a predetermined number of input pulses thereby producing a predetermined delay interval.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
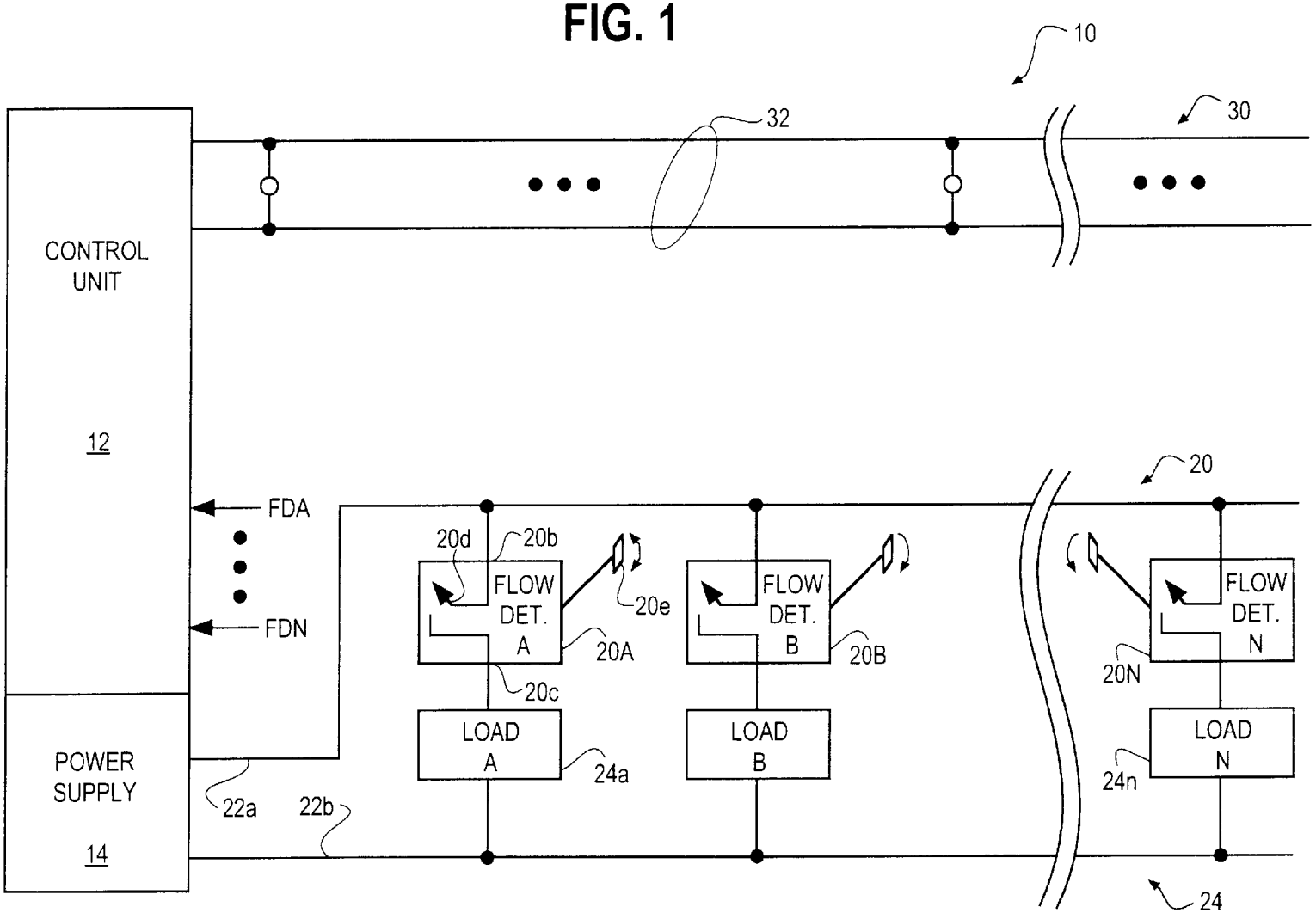
FIG. 1 is a block diagram of an alarm system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 which embodies the present invention. The system 10 includes a control unit 12 which could be implemented at least in part with a programmable processor. In such an instance, control programs would be stored in the unit 12 for execution by the processor.

The control unit 12 includes a switchable power supply 14. The switchable power supply can be turned on and off in accordance with the instructions from the control unit 12. The supply 14 can provide AC at its output terminals.

A plurality of fluid flow detectors 20 is coupled via lines 22*a,* 22*b* to the power supply 14. Associated with the plurality 20 is a plurality of corresponding loads 24.

Those with skill in the art will understand that the plurality of loads 24 could correspond to separate audible or visible alarm indicating devices. Alternately, the numbers of the plurality 24 could be combined together in a single audible or visible alarm indicating device. Finally, it will be understood that where one or more members of the plurality 24 are associated with one or more of the plurality 20, that separate load activating signals FDA–FDN can be provided to control unit 12 for purposes of supervising the operation of the respective numbers of the pluralities 20, 24.

Each of the members of the plurality 20, for example as illustrated by member 20A, includes first and second power terminals 20*b,* 20*c*. Further, each of the members of the plurality 20 includes a shorting switch, indicated for example as the switch 20*d*.

Each of the flow detectors, includes a flow sensor, for example indicated as sensor 20*e*. The respective flow sensors can be located in pipes or conduits which contain fire suppressing fluids such as, for example, water. Various types of flow sensors can be used without departing from the spirit and scope of the present invention.

The above noted patents, incorporated herein by reference, teach various types of flow sensors. Those of skill in the art will understand that elements, rotatable by a flowing liquid, can be used to provide switch closing (or opening) mechanical motion. Electronic flow sensors can also be used without departing from the spirit and scope of the present invention.

In response to the presence of heat or flame of a sufficient temperature, one or more of the sprinkler heads can be activated causing a flow of fluid in a respective pipe or conduit. If a valve is opened, a flow of fluid will result. The flow is detected by the flow sensors, such as the sensor 20*e,* of the detector 20A.

In response to non-transient flow, the switch 20*d* is closed thereby short circuiting terminals 20*b,* 20*c*. This provides maximum available energy to the respective load member of the plurality 24.

The switch 20*d* will be retained in its closed circuit state so long as the flow indicating sensor, 20*e,* provides an appropriate indicator of on-going flow. In such an instance, the corresponding load, such as the load 24*a,* will be energized and provide an audible or visible alarm.

Alternately, or in addition, a corresponding signal FDA can be provided to control unit 12 indicative of detected flow from the unit 20*a*. In such an instance, the control unit 12 can be enabled to provide one or more additional alarms if desired.

The control unit 12 can also be used with a plurality of non-flow, ambient condition detectors 30. Typical detectors include smoke, heat, or flame detectors. The members of the plurality 30 can communicate with the control unit 12 by means of a communication link 32.

Figure 2:
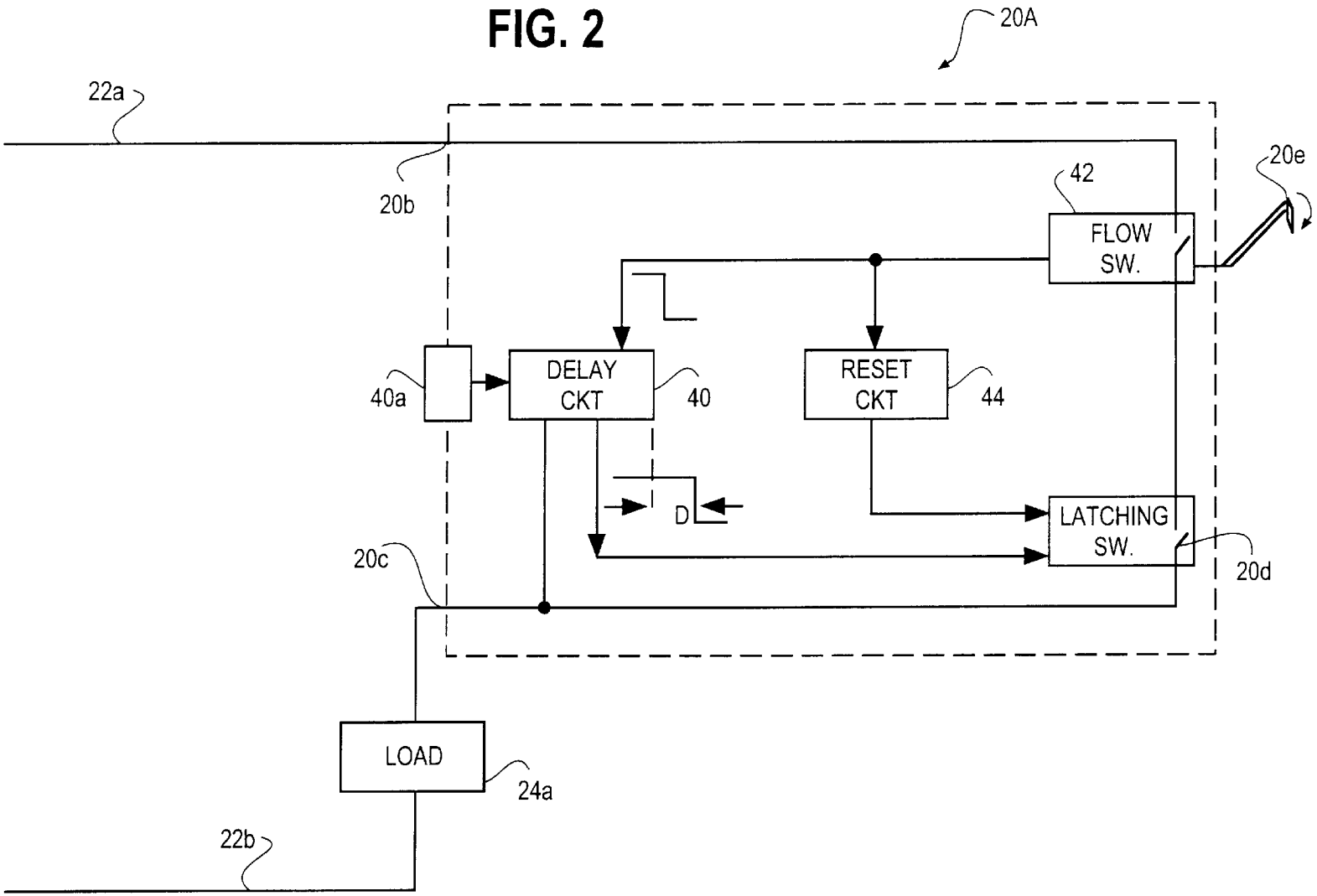
FIG. 2 is an over-all block diagram of a flow detector usable in the system of FIG. 1.

FIG. 2 illustrates more details of representative flow detector 20A. Only flow detector 20A needs to be discussed as the others, 20B–20N are substantially identical. The representative detector 20A includes a solid state delay circuit 40. In addition, the detector 20A includes a main flow indicating switch 42 coupled to a flow sensor, such as the flow sensor 20*e*.

In response to the flow sensor 20*e* sensing the presence of flow in an associated fluid, the switch 42 will change state, for example going from an open to a closed state. The switch 42 will remain closed so long as fluid flow continues to be sensed by the sensor 20*e*. In the event that flow ceases, the sensor 20*e* will indicate an absence of flow thereupon permitting switch 42 to assume a no flow, open circuit, state.

Switch 42 is coupled in series with switch 20*d* discussed previously. When both switch 42 and switch 20*d* are closed, a short circuit exists between terminals 20*b,* 20*c*. In this condition, electrical energy applied to terminal 20*b* is transferred directly to a respective external load 24*a* which could be an audible (horn, bell, gong, etc.) or visible (strobe light) alarm device.

The switch 20*d* is preferably implemented as a mechanical latching switch. The switches 42 and 20*d,* when closed, provide very low impedance mechanical electrical paths between the terminals 20*b, c,* thereby reducing energy losses in the detector 20*a* and providing maximal energy to the respective load.

The detector 20A also includes reset circuitry which could be implemented, as a monostable multivibrator or one-shot 44. When the control unit 12 energizes the power supply 14, and electrical energy is delivered to the members of the plurality such as the detector 20A, the reset circuitry 44 generates electrical signals, for example a single pulse, for the purpose of open-circuiting the latch 20*d*.

In the reset state, the delay circuit 40 is always energized by electrical energy supplied between terminals 20*b, c.* In this condition, the delay circuitry is preferably forced into a low power consuming quiescent state.

In response to sensor 20*e* detecting fluid flow, main flow switch 42 closes thereupon triggering the operation of delay circuitry 40. Delay circuitry 40 could be implemented for example, as a programmable timer which can be counted down (or up) when enabled.

When the delay circuitry 40 counts down from its preset state, or up from its preset state depending on the selected hardware configuration, an output signal delayed in time D sec. is generated. This signal, indicated as a downgoing signal in FIG. 2, is in turn used to close latching switch 20*d*. A short circuit is now being imposed now terminals 20*b, c.* Energy will be continuously to load 24*a* so long as flow switch 42 stays closed (flow continues), latching switch stays closed, and power is not removed from the system.

It will be understood by those of skill in the art that each time main flow switch 42 changes state, closes for example, indicate flow, delay circuit 40 will be enabled and the delay interval is initiated. Each time main flow switch 42 indicates a cessation of flow, opens for example, delay circuit 40 is reset. Resetting delay circuit 40 in turn resets latching switch 20*d* in the event that that switch has been closed.

The members of the plurality 20, as exemplified by the flow detector 20A of FIG. 2 utilize very little electrical energy in the no flow state. In a closed circuit state, assuming also the latch switch 20*d* has been closed, there is only a minimal increase in power dissipated in the unit 20A beyond that which is dissipated in its quiescent state due to the fact that switches 42 and 20*d* provide a short circuit between terminals 20*b, c.*

Each time flow switch 42 exhibits a no flow, open circuit state, it resets delay circuitry 40 which in turn resets switch 20*d.* A plurality of manually settable programming switches 40*a* is provided, coupled to delay circuit 40, for purposes of establishing the delay interval D.

Figure 3:
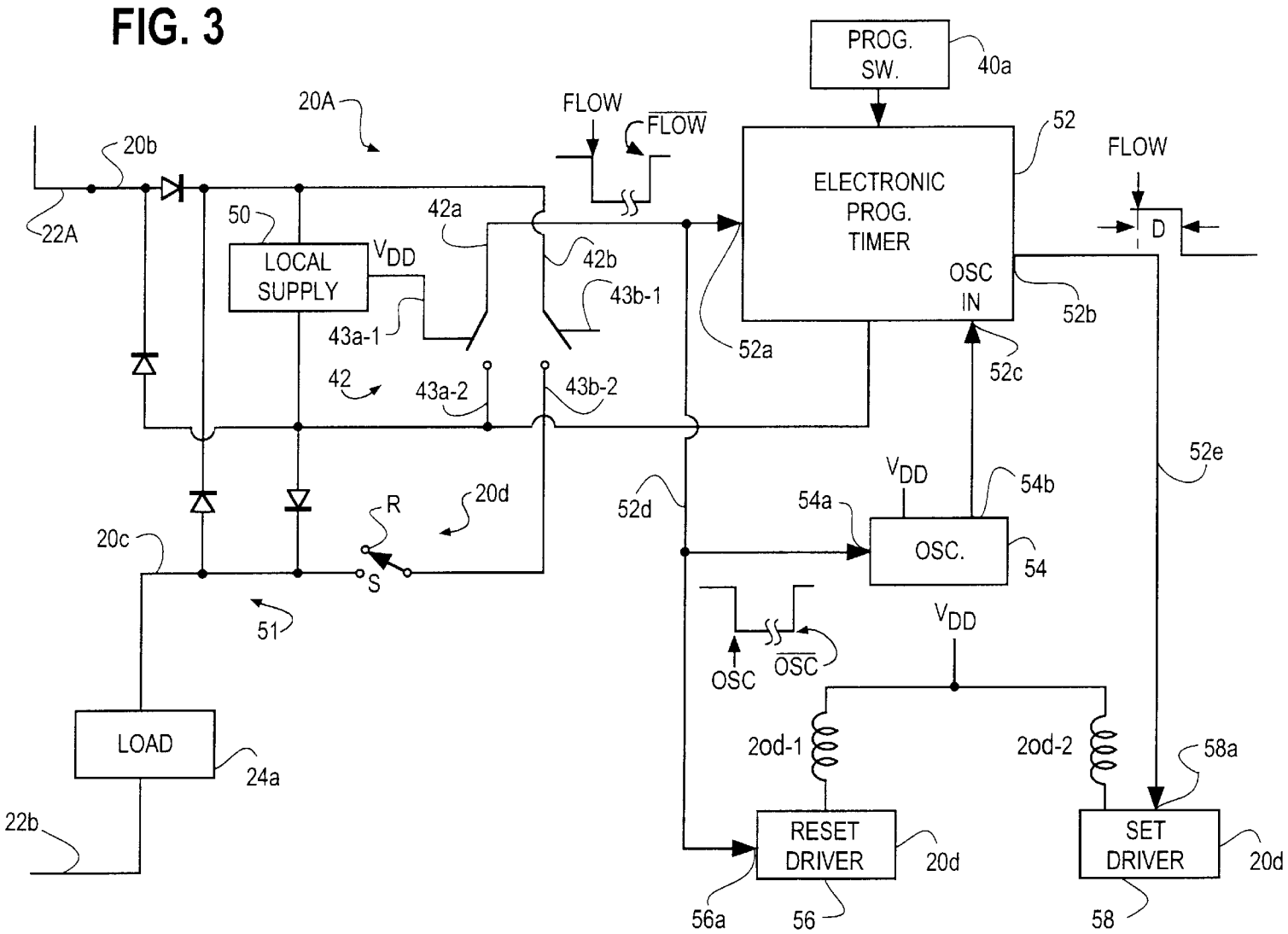
FIG. 3 is a more detailed, schematic diagram of the flow sensor of FIG. 2.

FIG. 3 illustrates the detector 20A in more detail. The detector 20A includes a local power supply 50 for providing a local source of electrical energy. The supply 50 is fed by a full wave bridge rectifier indicated at 51. The delay circuit 40 can include a programmable electronic timer 52 with a reset input 52*a* and a delayed output, depending on the setting of the program switches 40*a,* at output port 52*b.* Timer 52 can be driven by a pulse source applied at input port 52*c.*

The main flow switch 42 can be implemented, for example, as a Form C, double pole double throw switch having poles 42*a, b.* Each of the poles 42*a, b* has an associated normally closed contact 43*a*-1 43*b*-1 and a normally open contact 43*a*-2, 43*b*-2.

FIG. 3 illustrates switch 42 in a no flow state. In this condition, a voltage, generated by supply 50, is coupled via pole 42*a* to reset input 52*a* of timer 52 thereby causing the timer 52 to remain in an inactive, reset, state. The reset signal, input port 52*a,* is also coupled via a line 52*d* to an oscillator 54 with a control input port 54*a* and an output port 54*b.*

As illustrated in FIG. 3, in a no flow condition, a relatively high signal is coupled via the line 52*d* to the input control port 54*a* of oscillator 54 thereby holding the oscillator in a relatively low power, non-oscillating, quiescent state. The line 52*d* also coupled to an input port 56*a* of reset driver circuitry 56.

Reset driver circuitry 56 is coupled to a reset coil 20*d*-1 of latching switch 20*d.* Reset drive circuitry 56 will energize coil 20*d*-1, thereby resetting latching relay 20*d,* in response to a signal on the line 52*d* going from a low, flow indicating state to a relatively high, no flow, state.

The delay signal output port 52*b* of timer 52, is coupled via a line 52*e* to set driver circuitry 58 which has an input port 58*a.* Set driver circuitry 58 is in turn coupled to a set or closure coil 20*d*-2 of the latching switch 20*d.* Set driver circuitry 58, in response, for example to a delayed, down going signal, energizes the set relay coil 20*d*-2 thereby causing relay 20*d* to close or assume a "set" state.

When electrical energy is initially applied to the members of the plurality 20, by switching on the power supply 14, as illustrated in FIG. 3, the flow detectors will receive electrical energy via a respective input terminal, such as terminal 20*b.* Assuming a no flow condition, a high signal will be applied to the reset input port of timer 52 forcing it into a reset state. The same high signal will be applied to the input port 56*a* of reset driver circuitry 56 thereby open circuiting latching switch 20*d,* and, via a respective input terminal, such as control port 54*a* forcing oscillator 54 into its non-oscillatory quiescent state. In this condition, no electrical energy is coupled between the terminals 20*b, c.*

In the presence of flow in the respective conduit, sensor 20*e* will in turn cause the flow switch 42 to change state thereupon placing a relatively low voltage at the reset input port 52*a* of the timer 52, at the input port to drive circuitry 56 and at the input port of oscillator 54. This will in turn permit oscillator 54 to generate a plurality of pulses at its output port 54*b.* These pulses are in turn coupled, via line 54*c,* to oscillator input port 52*c* of timer 52. The string of input pulses causes the timer 52 to count up or down from its preset state, dictated by the switches 40*a.*

After a delay interval D, a down going pulse is generated at output port 52*b* and coupled by line 52*e* to input port 58*a* of drive circuitry 58. This in turn energizes the coil 20*d*-2 causing relay 20*d,* which could be implemented as a latching relay, to set or change state. In this condition, with switch 42 indicating a flow condition and latching relay 20*d* in a set state, electrical energy will be provided by a short-circuited path between terminals 20*b, c* to respective load 24*a.* Energy will continue to be provided in this fashion until flow ceases or until power supply 14 is turned off. In this instance, time 52 is reset, latching relay 20*d* is reset and oscillator 54 is disabled thereby forcing the detector 20A into a very low power quiescent state.

It will be understood that switches 42 and 20*d* could be implemented with solid state devices without departing from the spirit and scope of the present invention. Timer 52, oscillator 54, and coil drive circuits 56, 58 could similarly be implemented with a variety of circuits without departing from the spirit and scope hereof.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A detector comprising:

a sensor of fluid flow;

a first switch having first and second states, coupled to the sensor, wherein when in the second state, the first switch exhibits a low electrical impedance;

an electronic timer, coupled to the first switch, wherein the timer is activated each time the first switch goes from the first state to the second state in response to flow having been detected by the sensor and wherein the timer generates an output after a selected delay, in response thereto; and a second switch having third and fourth states, wherein when in the fourth state, the second switch exhibits a low electrical impedance, and wherein the second switch goes from the third state to the fourth state in response to the output provided that the first switch is still in the second state.

2. A detector as in claim 1 wherein the switches are coupled in series and wherein the second and fourth states correspond in each instance to a closed circuit.

3. A detector as in claim 2 which includes a power input terminal coupled to one of the switches and a load output terminal coupled to the other whereby electrical energy can be delivered to the load output terminal when both switches exhibit a closed circuit.

4. A detector as in claim 1 wherein in the absence of flow the first switch goes from the second state to the first state and thereupon resets the timer.

5. A detector as in claim 1 wherein the second switch incorporates a mechanical latch.

6. A detector as in claim 1 wherein the timer comprises a digital, programmable timer circuit.

7. A detector as in claim 5 wherein the second switch is forced to the third, open circuit, state on power up.

8. A detector as in claim 1 which includes a source of pulses coupled to the timer.

9. A detector as in claim 8 wherein the timer includes a solid state counter.

10. A detector as in claim 1 wherein the source of pulses is disabled when the first switch is in the first state.

11. A detector as in claim 8 wherein the timer is held in a reset state while the first switch is in the first state.

12. A detector as in claim 1 which includes first and second terminals and wherein the second switch, when in the fourth state, short circuits the terminals thereby maximizing electrical energy to a load.

13. A detector as in claim 1 which includes a local power supply.

14. A detector as in claim 13 usable with a switchable AC supply and which includes a rectifier circuit coupled to the power supply.

15. A monitoring system comprising:

a control element;

a switchable power supply coupled to the control element; and at least one flow detector, which includes;

a fluid flow sensor, coupled to the power supply;

a solid state timer, coupled to the flow sensor, wherein the timer is enabled to establish a delay interval in response to detected flow and is reset in response to a cessation of flow; and a latching electrical switch which has first and second states wherein the switch changes state in response to the timer indicating a termination of the delay interval provided the flow sensor has continuously detected flow during the interval and wherein when the power supply is switched on the latching switch assumes the first state; and which includes a plurality of ambient condition detectors from a class which includes smoke detectors, gas detectors, heat detectors, and intrusion detectors.

16. A system as in claim 15 wherein the flow detector includes first and second terminals with one of the terminals coupled to the power supply and with the other couplable to a load wherein the latching switch, when in the second state, short circuits the terminals.

17. A system as in claim 15 wherein the fluid flow sensor includes an element movable in response to adjacent fluid flow.

18. A system as in claim 15 wherein the flow detector in response to energy being applied thereto assumes a minimal power dissipating quiescent state.

19. A system as in claim 15 wherein said at least one flow detector includes a plurality of flow detectors coupled in parallel, wherein when energy is applied to the plurality of flow detectors and the flow detectors are in a quiescent state, the aggregate current flow through the plurality of flow detectors is below a minimum detectable threshold.

20. A detector comprising:

a sensor of fluid flow;

a first switch having first and second states, coupled to the sensor, wherein when in the second state, the first switch exhibits a low electrical impedance;

an electronic timer, coupled to the first switch, wherein the timer is activated each time the first switch goes from the first state to the second state in response to flow having been detected by the sensor and wherein the timer generates a selected delay, in response thereto; and a second switch having third and fourth states, wherein when in the fourth state, the second switch exhibits a low impedance, and wherein the second switch goes from the third state to the fourth state, provided that the first switch is still in the second state after the selected delay.

21. A detector comprising:

first and second electrical switches wherein the first switch goes from an open state to a closed state in response to a detected condition, wherein the second switch goes from an open state to a closed state, in response to closure of the first switch, after a selected delay interval provided that the first switch has stayed closed during the delay interval; and circuitry for establishing the delay interval coupled at least to the first switch, wherein the circuitry receives a reset signal substantially immediately in response to the first switch returning to the open state.

22. A detector as in claim 21 wherein each of the switches in the closed state exhibits a short circuit.

23. A detector as in claim 21 wherein each of the switches comprises a closable mechanical contact.

24. A detector as in claim 21 wherein the delay circuitry exhibits a minimal power drawing quiescent state when the first switch is in the open state.

25. A detector as in claim 21 wherein the second switch latches in its closed state.

26. A detector as in claim 25 wherein a short circuit exists across the switches in response to both switches being in the closed state.

* * * * *